US005611104A

United States Patent [19]

DeMars

[11] Patent Number: 5,611,104

[45] Date of Patent: Mar. 18, 1997

[54] MOP HEAD WRINGER TO BE USED WITH A BUCKET

[76] Inventor: Robert A. DeMars, 5000 N. Parkway Calabasas, Suite 233, Calabasas, Calif. 91302

[21] Appl. No.: 652,983

[22] Filed: May 24, 1996

[51] Int. Cl.[6] ..... A47L 13/142; A47L 13/58

[52] U.S. Cl. ..... 15/263; 15/264; 100/132

[58] Field of Search ..... 15/260, 263, 264; 68/243; 100/131, 132, 266

[56] References Cited

U.S. PATENT DOCUMENTS

| | | | |
|---|---|---|---|
| 217,675 | 7/1879 | Boswell | 15/263 |
| 668,102 | 2/1901 | Johnson | 15/263 |
| 4,464,809 | 8/1984 | Trisolini | 15/260 |
| 5,361,448 | 11/1994 | Chao | 15/263 |

FOREIGN PATENT DOCUMENTS

| | | | |
|---|---|---|---|
| 1520839 | 8/1978 | United Kingdom | 15/264 |

*Primary Examiner*—David Scherbel
*Assistant Examiner*—Terrence R. Till
*Attorney, Agent, or Firm*—Jack C. Munro

[57] ABSTRACT

A mop head wringer is designed to be placed on a bucket and used therewith. The mop head wringer includes a screen basket which is mounted within a supporting frame. The screen basket is to be movable from an upper at-rest position to a lower wringing position. The screen basket is mounted on a shaft with the shaft being rotated as it moves from the upper position to the lower position. A mop head placed within the screen basket causes the screen basket to move from the upper position to the lower position which causes the application of the wringing force by rotation of the screen basket to the mop head.

11 Claims, 2 Drawing Sheets

MOP HEAD WRINGER TO BE USED WITH A BUCKET

BACKGROUND OF THE INVENTION

1. Field of the Invention

The field of this invention relates to appliances that facilitate cleaning of floors and more particularly to a mop head wringer designed to be used in conjunction with a mop to effect wringing of the mop head to remove excess moisture.

2. Description of the Prior Art

A mop generally comprises an elongated handle to which is attached a mop head. The mop head is formed of a plurality of strands of material. In the past, typically the strands of material have comprised a fabric which is formed into the shape of a plurality of lengths of twisted rope. Within recent years, mop heads are being constructed of utilizing strands of a artificially constructed sponge-like or chamois type of material. The normal procedure in using a mop is to place the mop within a bucket of water and rinse the mop out and then physically, by hand, wring the mop of excess moisture. The mop head is then used on the floor to clean an area of the floor. After the mop has been moved across the area, the mop head is placed back into the water, rinsed again, and removed from the water and manually wrung again to remove excess moisture and then reused on the floor. After two or three times of application on the floor, the water within the bucket, in which the mop is being rinsed, constitutes dirty water. Therefore, when the mop is then placed back on the floor, it is actually attempting to clean the floor with dirty water. Not only does this not achieve a clean floor, but it is also a practice that achieves an unsanitary floor.

One way to avoid the using of a dirty mop is to clean the floor by using a separate bucket which includes clean water. After the mop is wrung out after being rinsed with the dirty water, the mop can then be rinsed with the clean water, wrung out again and then used to clean the floor. This constant wringing procedure, when accomplished manually, is not only time consuming but certain individuals, like people with arthritis or little hand strength, have a tough time exerting enough manual wringing force in order to remove the excess moisture from the mop head.

In the past, there have been constructed mop buckets with wringing attachments. However, these wringing attachments have been relatively complex, therefore costly to manufacture and thereby costly when purchased by the consumer. Also, most wringers are permanently attached to a bucket with it not being possible to separate the wringer from the bucket. Therefore, only that particular bucket could be used with the wringer not being transferable to other buckets.

SUMMARY OF THE INVENTION

The primary objective of the present invention is to construct a mop head wringer which is used to remove excess moisture from a mop head eliminating the actual physical contact of the mop head by the user in order to produce a wringing of the mop head.

Another objective of the present invention is to construct a mop head wringer which is constructed of few parts and therefore can be manufactured relatively inexpensively and thereby sold to the ultimate consumer at a relatively inexpensive price.

The mop head wringer of the present invention is to be usable in conjunction with a bucket by being placed on top of the bucket with a portion of the mop head wringer being located within the internal chamber of the bucket. The mop head wringer includes a cover with this cover actually being supported on the upper lip of the bucket. A screen basket is mounted within this cover with an access opening being formed in the cover to provide access to the screen basket. The screen basket is mounted on a shaft with this shaft including a spiral groove. The shaft is mounted within a through opening of a spider shape supporting frame. A pin is attached to the supporting frame and connects with the spiral groove. The screen basket is movable by the weight of the mop head from an at-rest position to a wringing position. The screen basket is biased by a coil spring continuously toward the at-rest position. Upon insertion of a mop head in conjunction with screen basket, the screen basket will move with a twisting motion to a lower position, which constitutes the wringing position, and at the same time that it is moved, it will rotate approximately one and one-half revolutions. This will produce a wringing action of the mop head. The rotation is caused by the pin riding within the spiral groove formed within the shaft. The screen basket includes protruding fins which ride against a ring member which is mounted on the cover. The supporting fins in connection with the ring member provide a guide to keep the screen basket properly positioned in a vertical orientation during movement from the at-rest position to the wringing position.

DETAILED DESCRIPTION OF THE PREFERRED EMBODIMENT

Figure 1:
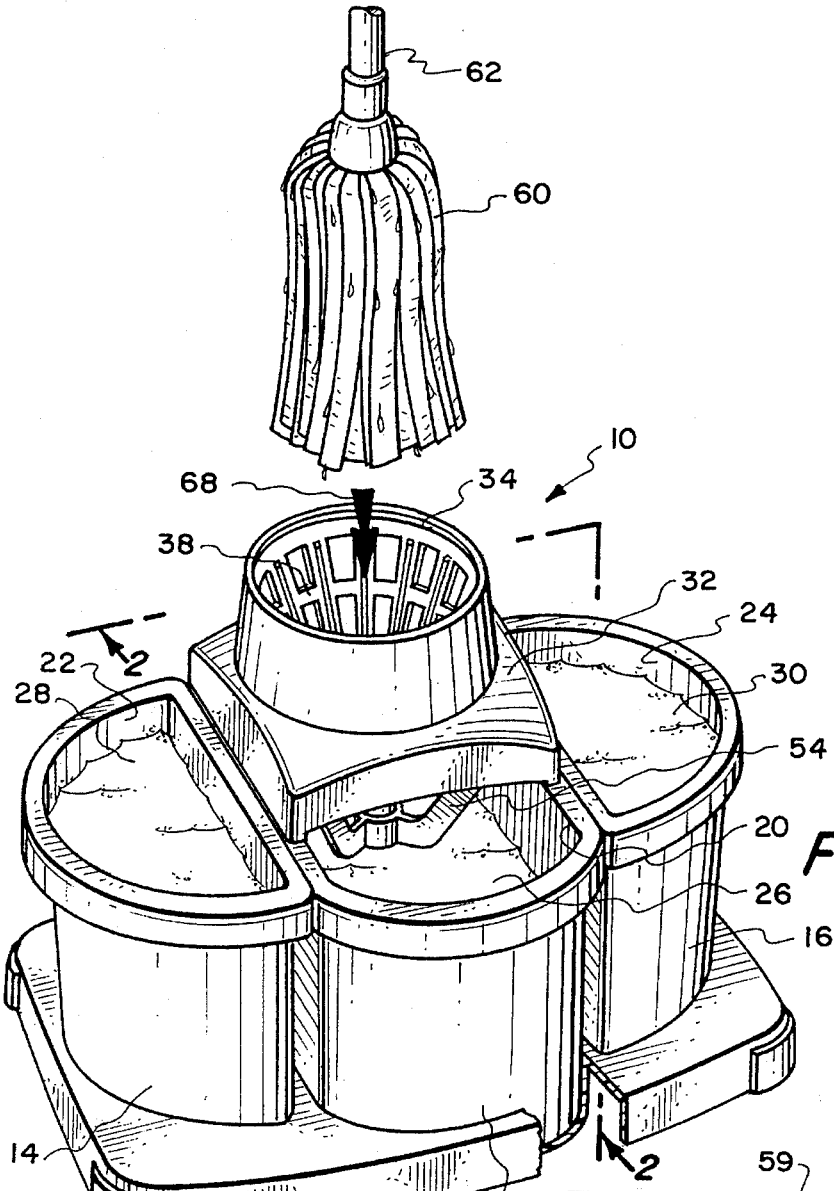
FIG. 1 is an isometric view of a bucket assembly showing the connection with the mop head wringer of the present invention and also depicting the connection of the mop head in conjunction with the mop head wringer.
Figure 4:
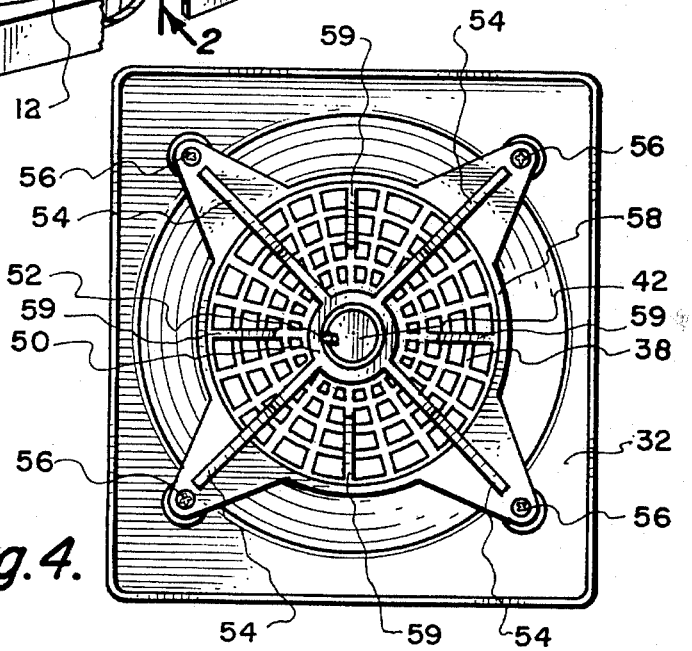
FIG. 4 is a transverse cross-sectional view through the mop head wringer of the present invention taken along line 4—4 of FIG. 2.

Referring particularly to the drawings, there is shown the mop bucket assembly 10 of this invention which is composed of a main bucket 12, washing bucket 14 and rinsing bucket 16 mounted on a base 18. Base 18 is adapted to rest on a supportive surface. Base 18 could include caster wheels (not shown) if desired. The buckets 14 and 16 are shown to be of a smaller volume than the volume of the main bucket 12. However, in actual practice the volume of washing bucket 14 and rinsing bucket 16 could be equal to or greater than main bucket 12. The main bucket 12 has an internal chamber 20. Washing bucket 14 has an internal chamber 22 with rinsing bucket 16 having an internal chamber 24. Normally the buckets 12, 14 and 16, as well as base 18, will be constructed of a plastic sheet material. A quantity of water 26 is to be contained within the main bucket 12. In a similar manner water 28 is to be contained within bucket 14 with water 30 to be contained within bucket 16.

Placed on the lip of main bucket 12 and covering about one-half of the opening into the main bucket 12 is a cover 32. Cover 32 includes an access opening 34. Cover 32 encloses an internal chamber 36. Located within the internal chamber 36 is a screen basket 38. Screen basket 38 will normally be constructed of plastic and is in the shape of an upside-down truncated cone. The bottom end 40 of the screen basket 38 is fixedly mounted onto a shaft 42. The shaft 42 includes a spiral groove 44. Surrounding the shaft 42 is a coil spring 46. One end of the coil spring 46 abuts against the bottom end 40 of the screen basket 38 with the opposite end of the coil spring 46 resting within annular recess 48 of a cup 50. Cup 50 includes a through hole 51. Mounted within the cup 50 is a pin 52 which connects with the through hole 51. The pin 52 rides within the groove 44 of the shaft 42.

The cup 50 is mounted within a supporting frame defined as a spider member 54. Spider member 54 includes four in number of legs which are fixedly mounted by fasteners 56 to portions of the cover 32. Also fixedly mounted to the cover 32 is a ring 58. The ring 58 is located about and functions to guide the screen basket 38.

Figure 3:
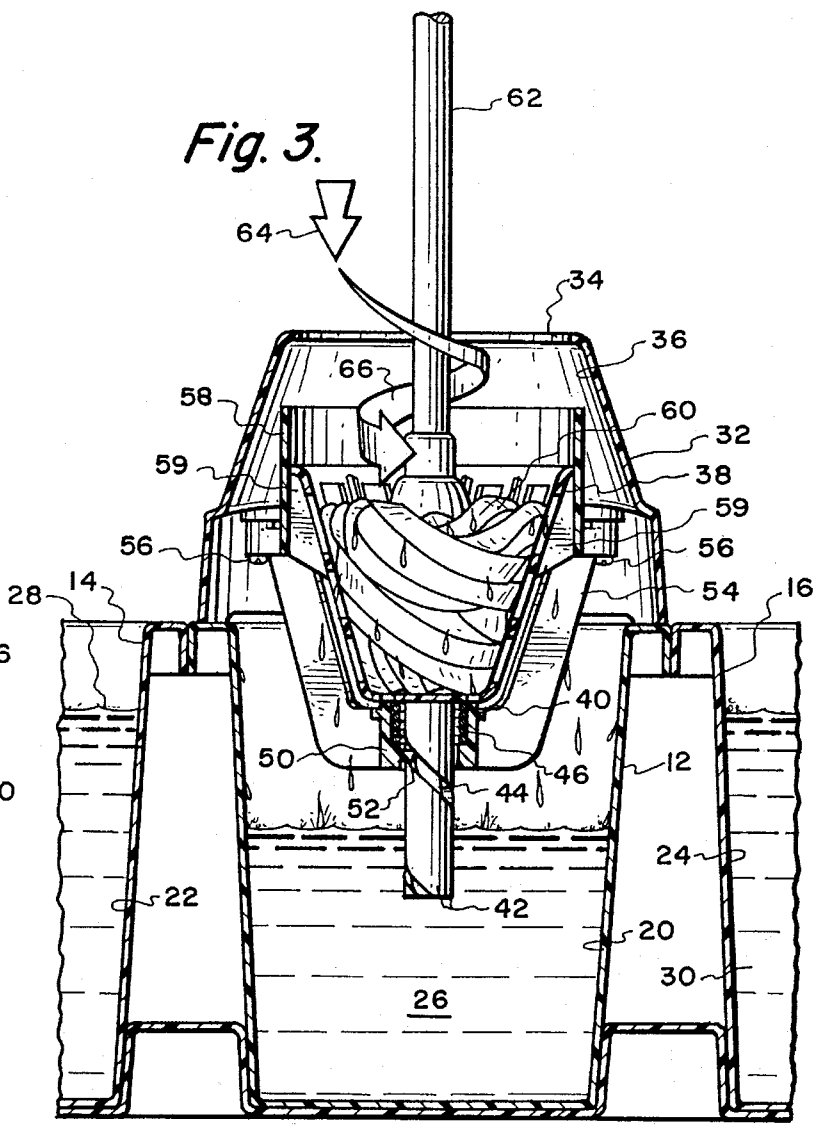
FIG. 3 is a cross-sectional view similar to FIG. 2 but showing the screen basket in the wringing position.
Figure 2:
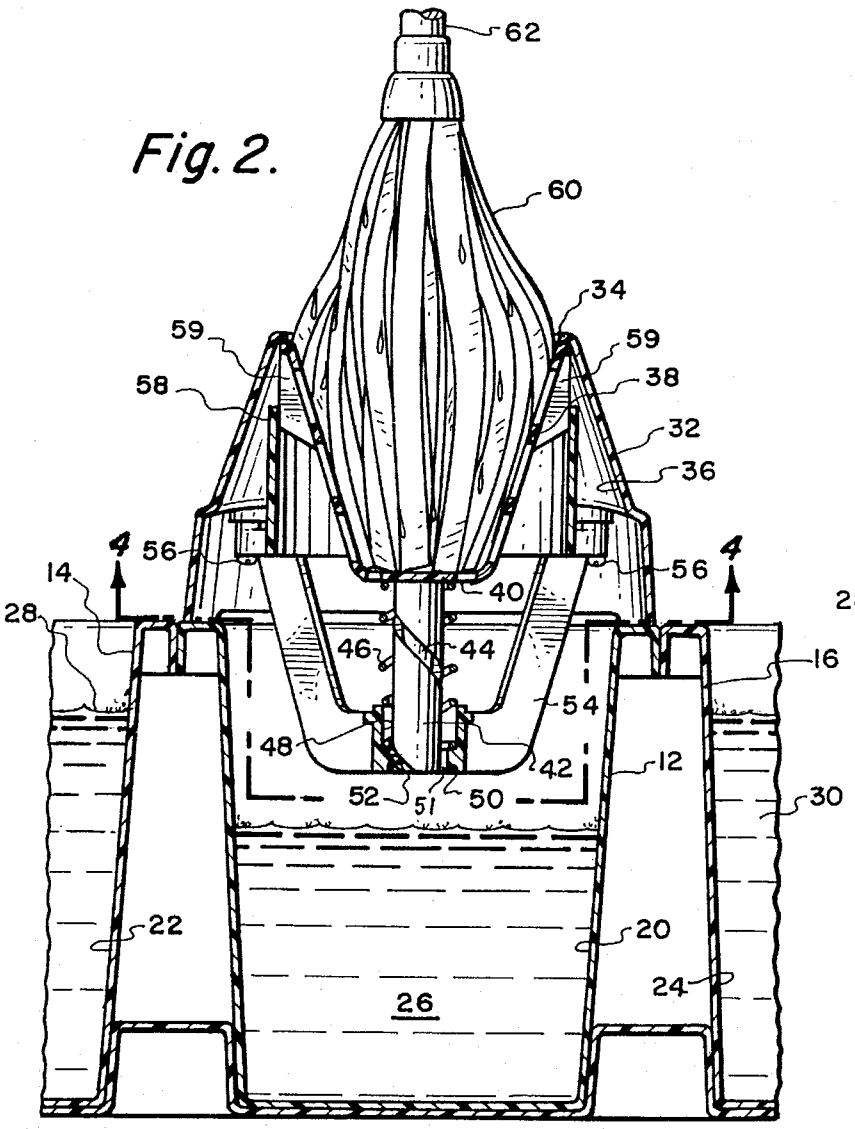
FIG. 2 is a cross-sectional view through the mop head wringer and bucket arrangement shown in FIG. 1 taken along line 2—2 of FIG. 1 showing the screen basket of the mop head wringer located in the at-rest position just being initially engaged by a mop head.

A handle 62 is grasped to which is attached a mop head 60. The mop head 60 can comprise any conventional strands of material which can be strands of a sponge-like absorbent material or can be fabric. The mop head 60 is to be first immersed within the water 26. The mop head 60 is rinsed within the water 26 and then extracted with the mop head 60 placed within the screen basket 38. The inserting of the mop head 60 into the screen basket 38 is depicted by arrow 68. The weight of the mop head 60 and the handle 62 will be sufficient to cause the screen basket 38 to be moved from the upper position shown in FIG. 2 to the lower position shown in FIG. 3. The screen basket 38 is prevented from tilting by the ring 58 as it moves from the at-rest position to the lower position by fins (four in number) 59, which are integral with screen basket 38 riding along the inside surface of ring 58. As the screen basket 38 moves to the wringing position, it is automatically turned about one and one-half revolutions by the pin 52 riding within the spiral groove 44. Therefore when the mop head 60 is inserted within the screen basket 38, the screen basket 38 will then automatically move to the lower (wringing) position and will rotate the one and one-half revolutions. Downward rotational movement of the screen basket 38 is depicted generally by arrows 64 and 66. This turning or twisting of the screen basket 38 will cause excess water contained within the mop head 60 to be wrung from the mop head 60 and deposited into the internal chamber 20 of the main bucket 12. When the mop head 60 is now removed from the screen basket 38, the screen basket 38 will again rise to the position shown in FIG. 2 in contact with cover 32 which functions as a stop due to the pressure applied by the coil spring 46. The coil spring 46 has just a sufficient amount of force to counterbalance the weight of the screen basket 38.

The normal operation of the mop bucket assembly 10 of this invention is as follows: Let it be assumed that water 28 includes a small amount of detergent. The user will start by inserting the mop head 60 within the water 26 rinsing the mop head 60. The user will then insert the mop head 60 in the screen basket 38 causing such to move to the lower position and wringing of the mop head 60 to remove excess water. The user then removes the mop head 60 from the screen basket 38 and is to insert it within water 28 of the bucket 14. The user then reinserts mop head 60 again with the screen basket 38 to remove excess water. Because the mop head 60 is then inserted within relatively clean water 28, clean water 28 will now be applied to the floor (not shown) as the mop head 60 is used to clean the floor.

After usage of the mop head 60 on a given area of the floor, the user will then insert the mop head 60 within the water 26 and rinse the mop head 60. The mop head 60 is then reinserted in conjunction with the screen basket 38 to effect wringing of the excess water from the mop head 60. The mop head 60 can then be inserted in conjunction with the water 30 which will normally comprise a clean rinse water. The mop head 60 is rinsed in the water 30 and then reinserted in the screen basket 38 automatically causing wringing action to remove excess water. Now the quite clean mop head 60 is then used to go over the area which was cleaned previously on the floor thereby rinsing that area. The procedure is then repeated for other areas of the floor.

What is claimed is:

1. A mop head wringer to be used with a bucket comprising:

a supporting frame having a through hole, a pin mounted on said supporting frame, said pin protruding into said through hole;

a shaft mounted within said through hole, said shaft having a spiral groove, said pin riding within said spiral groove; and a screen basket fixed to said shaft, said screen basket being movable between an at-rest position and a wringing position, a spring connected between said screen basket and said supporting frame, said spring exerting a continuous bias tending to locate said screen basket in said at-rest position, whereby upon insertion of the mop head within said screen basket said screen basket is moved to said wringing position while rotating of said screen basket exerting a wringing force against the mop head causing removal of excess moisture from the mop head.

2. The mop head wringer as defined in claim 1 wherein:

said through hole being centrally located within said supporting frame.

3. The mop head wringer as defined in claim 1 wherein:

said supporting frame comprising a spider member having a plurality in number of spaced apart legs with spaces located between said legs.

4. The mop head wringer as defined in claim 1 wherein:

said spring comprising a coil spring, said coil spring being mounted about said shaft.

5. The mop head wringer as defined in claim 1 wherein:

a ring member being mounted on said supporting frame, said screen basket located within said ring member and being guided by said wring member during movement between said at-rest position and said wringing position.

6. The mop head wringer as defined in claim 5 wherein:

fins being mounted on said screen basket, said fins protruding exteriorly from said basket, said fins to ride on said ring member during movement between said at-rest position and said wringing position.

7. The mop head wringer as defined in claim 5 wherein:

a cover covering said supporting frame and said ring member, said cover including an access opening, said supporting frame and said ring member being mounted on said cover, said cover adapted to rest on a bucket, said access opening providing access to said screen basket, said screen basket contacting said cover when in said at-rest position.

8. The mop head wringer as defined in claim 7 wherein:

fins being mounted on said screen basket, said fins protruding exteriorly from said basket, said fins to ride on said ring member during movement between said at-rest position and said wringing position.

9. The mop head wringer as defined in claim 8 wherein:

said through hole being centrally located within said supporting frame.

10. The mop head wringer as defined in claim 9 wherein:

said supporting frame comprising a spider member having a plurality in number of spaced apart legs with spaces located between said legs.

11. The mop head wringer as defined in claim 10 wherein:

said spring comprising a coil spring, said coil spring being mounted about said shaft.

* * * * *